US009928784B2

(12) United States Patent
Matsui

(10) Patent No.: US 9,928,784 B2
(45) Date of Patent: Mar. 27, 2018

(54) DISPLAY APPARATUS, GRADATION CORRECTION MAP GENERATING DEVICE, GRADATION CORRECTION MAP GENERATING METHOD, AND PROGRAM

(71) Applicant: NEC DISPLAY SOLUTIONS, LTD., Tokyo (JP)

(72) Inventor: Katsuyuki Matsui, Tokyo (JP)

(73) Assignee: NEC DISPLAY SOLUTIONS, LTD., Tokyo (JP)

( * ) Notice: Subject to any disclaimer, the term of this patent is extended or adjusted under 35 U.S.C. 154(b) by 163 days.

(21) Appl. No.: 14/878,086

(22) Filed: Oct. 8, 2015

(65) Prior Publication Data

US 2016/0104434 A1 Apr. 14, 2016

(30) Foreign Application Priority Data

Oct. 9, 2014 (JP) ..... 2014-207814

(51) Int. Cl.
*G09G 5/10* (2006.01)
*G09G 3/34* (2006.01)
*G09G 3/20* (2006.01)

(52) U.S. Cl.
CPC ..... *G09G 3/3406* (2013.01); *G09G 3/2003* (2013.01); *G09G 2320/0233* (2013.01); *G09G 2320/0242* (2013.01); *G09G 2320/0285* (2013.01); *G09G 2320/041* (2013.01); *G09G 2320/0673* (2013.01); *G09G 2340/0492* (2013.01)

(58) Field of Classification Search
CPC ..... G09G 3/3406; G09G 3/2003; G09G 2320/0233; G09G 2320/0242; G09G 2320/0285; G09G 2320/041; G09G 2320/0673; G09G 2340/0492
See application file for complete search history.

(56) References Cited

U.S. PATENT DOCUMENTS

2010/0060667 A1* 3/2010 Chen ..... G09G 5/10 345/690

FOREIGN PATENT DOCUMENTS

JP 2007-219062 A 8/2007

* cited by examiner

*Primary Examiner* — Peter D McLoone
(74) *Attorney, Agent, or Firm* — McGinn IP Law Group, PLLC

(57) ABSTRACT

A gradation correction map generating unit generates a gradation correction map based on a brightness unevenness map, a rotation unevenness map, and a second gamma characteristic. The brightness unevenness map indicates a correspondence relation between a plurality of positions in a screen of a display unit, and uncorrected brightness values, the uncorrected brightness values being brightness values at time of performing no correction when the display unit is installed at a predetermined angle. The rotation unevenness map indicates a correspondence relation between the plurality of positions or other plurality of positions, and differences in brightness values corresponding to a rotation angle of the display unit. The second gamma characteristic indicates a correspondence relation between a brightness value at a specific position in the screen, and a gradation of an image signal.

18 Claims, 10 Drawing Sheets

FIG. 3

| GRADATION | POSITION IN SCREEN OF DISPLAY UNIT | | GRADATION CORRECTION VALUES |
|---|---|---|---|
| | x | y | |
| 255 | x1 | y1 | 230 |
| | x1 | y2 | 225 |
| | ... | ... | ... |
| | x20 | y11 | 235 |
| 192 | x1 | y1 | 178 |
| | ... | ... | ... |
| 128 | x1 | y1 | 110 |
| | ... | ... | ... |
| 64 | x1 | y1 | 58 |
| | ... | ... | ... |
| 0 | x1 | y1 | 0 |
| | ... | ... | ... |

FIG. 7

| GRADATION | POSITION IN SCREEN OF DISPLAY UNIT | | GRADATION CORRECTION VALUE |
|---|---|---|---|
| | x | y | |
| 255 | x1 | y1 | 234 |
| | x1 | y2 | 228 |
| | ... | ... | ... |
| | x20 | y11 | 238 |
| 192 | x1 | y1 | 180 |
| | ... | ... | ... |
| 128 | x1 | y1 | 113 |
| | ... | ... | ... |
| 64 | x1 | y1 | 60 |
| | ... | ... | ... |
| 0 | x1 | y1 | 1 |
| | ... | ... | ... |

DISPLAY APPARATUS, GRADATION CORRECTION MAP GENERATING DEVICE, GRADATION CORRECTION MAP GENERATING METHOD, AND PROGRAM

This application is based upon and claims the benefit of priority from Japanese patent application No. 2014-207814, filed on Oct. 9, 2014, the disclosure of which is incorporated herein in its entirety by reference.

BACKGROUND OF THE INVENTION

Field of the Invention

The present invention relates to a display apparatus, a gradation correction map generating device, a gradation correction map generating method, and a program.

Description of the Related Art

For a display used in medical use or graphic design services, display characteristics that reproduce uniform color over an entire screen are required.

In Japanese Unexamined Patent Application, First Publication No. 2007-219062, a technique that visually corrects display unevenness in order to equalize the display characteristics has been described as a related art.

Moreover, a human image frequently has a vertically long size, and some medical users or graphic users frequently use a display apparatus in a vertical screen (Pivot function) by rotating the display apparatus. Because the display apparatus has been made thinner and lighter to improve installation flexibility, there are increasing needs to rotate the display apparatus from horizontally long to vertically long.

However, in the above-described-display unevenness, the state of display unevenness changes depending on rotation processing of the display apparatus.

By rotating the display apparatus from horizontally long to vertically long, hot air stagnates in an upper part of the display apparatus. Therefore, temperature distribution in a display screen of the display apparatus changes due to rotation of the display apparatus, thereby changing brightness and chromaticity at each point in the screen.

That is to say, as the temperature increases due to the hot air stagnating in the upper part of the display apparatus, luminous efficiency of the fluorescent material of the backlight decreases due to temperature dependency of the backlight light source, so that brightness at each point in the screen decreases, and chromaticity changes to blue.

Moreover, by rotating the display apparatus, a portion being a high-temperature portion changes in the display screen, and hence, adjustment of temperature unevenness in every direction of the screen is difficult.

At the time of adjustment, an optical measuring instrument dedicated for measurement of the display screen, and a darkroom in which the display apparatus is arranged at the time of measurement are required as factory equipment that produces the display apparatus. Moreover, after rotating the display apparatus, an aging time until the temperature becomes a stable state in which the temperature at the high-temperature portion does not change is required (for example, one hour is required for each direction of the display screen), and hence, adjustment per display apparatus takes time.

Accordingly, in a busy factory, variations in the aging time occur in the adjustment by each worker, and the degree of adjustment is different for each display apparatus. On a user side, when the user adjusts the display unevenness in the rotation of a display unit (performs unevenness correction described later), it is difficult to perform sufficient adjustment of display unevenness because the user does not have the optical measuring instrument dedicated for measurement of the display screen, nor the darkroom in which the display apparatus is arranged at the time of measurement.

SUMMARY OF THE INVENTION

An exemplary object of the present invention is to provide a display apparatus, a gradation correction map generating device, a gradation correction map generating method, and a program that can solve the above-described problems.

A display apparatus according to a first exemplary aspect of the present invention includes: an image input unit that receives an image signal; a display unit that includes a screen, the display unit being rotatable parallel to the screen; a gradation correction map generating device that generates a gradation correction map indicating a correspondence relation between a plurality of positions in the screen, and gradation correction values of the image signal at the plurality of positions; and a display control unit that corrects the image signal by using the gradation correction map The screen displays an image corresponding to the corrected image signal. The gradation correction map generating device generates the gradation correction map based on a brightness unevenness map, a rotation unevenness map, and a second gamma characteristic. The brightness unevenness map indicates a correspondence relation between the plurality of positions and uncorrected brightness values, the uncorrected brightness values being brightness values at time of performing no correction when the display unit is installed at a predetermined angle. The rotation unevenness map indicates a correspondence relation between the plurality of positions or other plurality of positions, and differences in brightness values corresponding to a rotation angle of the display unit. The second gamma characteristic indicates a correspondence relation between a brightness value at a specific position in the screen, and a gradation of the image signal.

A display apparatus according to a second exemplary aspect of the present invention includes: an image input unit that receives an image signal; a display unit that includes a screen, the display unit being rotatable parallel to the screen; a gradation correction map generating device that generates a gradation correction map indicating a correspondence relation between a plurality of positions in the screen, and gradation correction values of the image signal at the plurality of positions; and a display control unit that corrects the image signal by using the gradation correction map. The screen displays an image corresponding to the corrected image signal. The gradation correction map generating device includes: a rotation unevenness correction map generating unit that generates a rotation unevenness correction map indicating a correspondence relation between the plurality of positions, and correction values of brightness corresponding to a rotation angle of the display unit; a brightness correction map generating unit that generates a brightness correction map indicating a correspondence relation between the plurality of positions and brightness correction amounts; and a gradation correction map generating unit that generates the gradation correction map. The rotation unevenness correction map generating unit generates the rotation unevenness correction map based on a brightness correction map and a rotation unevenness map. The brightness correction map indicates a correspondence relation between the plurality of positions and uncorrected brightness values, the uncorrected brightness values being brightness values at time of performing no correction when the display unit is installed at a predetermined angle. The rotation unevenness map indicates a correspondence relation between the plurality of positions or other plurality of positions, and differences in brightness values corresponding to the rotation angle of the display unit. The brightness correction map generating unit generates the brightness correction map based on the rotation unevenness correction map, and a specified unevenness level value. The gradation correction map generating unit generates the gradation correction map based on the brightness correction map and a second gamma characteristic. The second gamma characteristic indicates a correspondence relation between a brightness value at a specific position in the screen, and a gradation of the image signal.

A gradation correction map generating device according to a third exemplary aspect of the present invention includes: a gradation correction map generating unit that generates a gradation correction map based on a brightness unevenness map, a rotation unevenness map, and a second gamma characteristic. The brightness unevenness map indicates a correspondence relation between a plurality of positions in a screen of a display unit, and uncorrected brightness values, the uncorrected brightness values being brightness values at time of performing no correction when the display unit is installed at a predetermined angle. The rotation unevenness map indicates a correspondence relation between the plurality of positions or other plurality of positions, and differences in brightness values corresponding to a rotation angle of the display unit. The second gamma characteristic indicates a correspondence relation between a brightness value at a specific position in the screen, and a gradation of an image signal.

A gradation correction map generating method according to a fourth exemplary aspect of the present invention includes: generating a gradation correction map based on a brightness unevenness map, a rotation unevenness map, and a second gamma characteristic. The brightness unevenness map indicates a correspondence relation between a plurality of positions in a screen of a display unit, and uncorrected brightness values, the uncorrected brightness values being brightness values at time of performing no correction when the display unit is installed at a predetermined angle. The rotation unevenness map indicating a correspondence relation between the plurality of positions or other plurality of positions, and differences in brightness values corresponding to a rotation angle of the display unit. The second gamma characteristic indicates a correspondence relation between a brightness value at a specific position in the screen, and a gradation of an image signal.

A non-transitory computer readable recording medium according to a fifth exemplary aspect of the present invention stores a program. The program causes a computer to execute: generating a gradation correction map based on a brightness unevenness map, a rotation unevenness map, and a second gamma characteristic. The brightness unevenness map indicates a correspondence relation between a plurality of positions in a screen of a display unit, and uncorrected brightness values, the uncorrected brightness values being brightness values at time of performing no correction when the display unit is installed at a predetermined angle. The rotation unevenness map indicating a correspondence relation between the plurality of positions or other plurality of positions, and differences in brightness values corresponding to a rotation angle of the display unit. The second gamma characteristic indicates a correspondence relation between a brightness value at a specific position in the screen, and a gradation of an image signal.

According to an exemplary aspect of the present invention, a display apparatus, a gradation correction map generating device, a gradation correction map generating method, and a program that can simplify a shipment process in a factory and perform correction of display unevenness in a general user environment, when a vertical direction and a horizontal direction of a display screen are changed by rotating the display apparatus, can be provided.

BRIEF DESCRIPTION OF THE DRAWINGS

FIG. 3 is a diagram showing an example of data of a gradation correction basic map, in the second exemplary embodiment of the present invention.

FIG. 7 is a diagram showing an example of data of the gradation correction basic map, in the second exemplary embodiment of the present invention.

EXEMPLARY EMBODIMENTS

First Exemplary Embodiment

A first exemplary embodiment of the present invention will be described with reference to the drawings.

Figure 1:
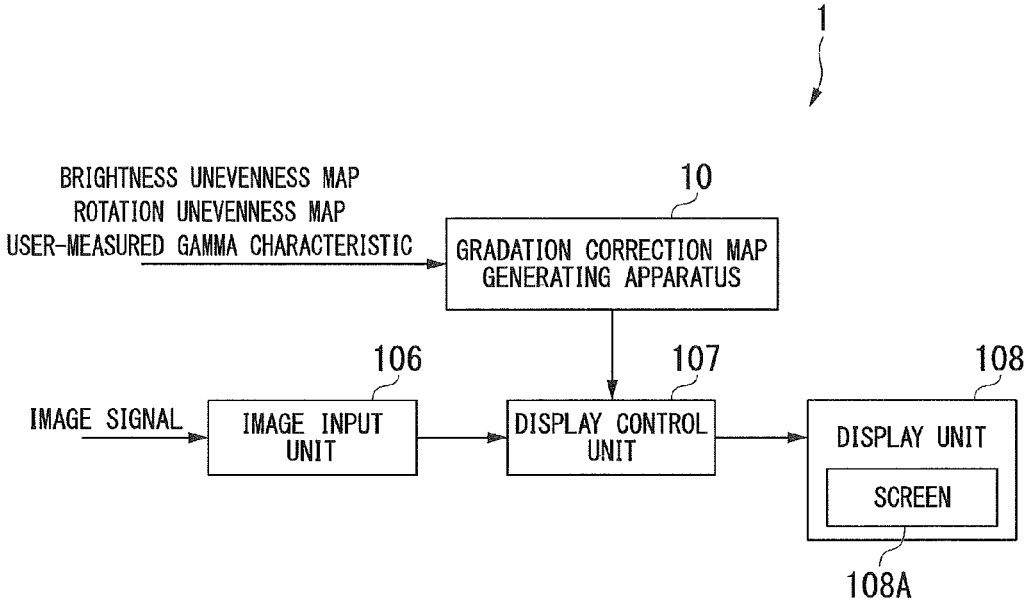
FIG. 1 is a block diagram showing a configuration example of a display apparatus according to a first exemplary embodiment of the present invention.

FIG. 1 is a block diagram showing a configuration example of a display apparatus 1 according to the first exemplary embodiment of the present invention.

In FIG. 1, the display apparatus 1 includes at least a gradation correction map generating apparatus 10, an image input unit 106, a display control unit 107, a display unit 108, and a-gamma measuring unit 111 (not shown in the drawing). The gradation correction map generating apparatus 10 may be referred to as the gradation correction map generating device 10.

The gradation correction map generating device 10 provided in the display apparatus 1 according to the first exemplary embodiment generates a gradation correction map indicating a correspondence relation between a plurality of positions in a screen 108A of the display unit 108, and a gradation correction value of an image signal at the plurality of positions. The gradation correction map generating device 10 generates the gradation correction map based on a brightness unevenness map, a rotation unevenness map, and a user-measured gamma characteristic (second gamma characteristic). The brightness unevenness map indicates a correspondence relation between the plurality of positions and uncorrected brightness being uncorrected brightness at the plurality of positions. The rotation unevenness map indicates an unevenness characteristic difference, being a difference in display unevenness at the plurality of positions, which is generated according to a rotation angle of the display unit 108. The user-measured gamma characteristic is measured at the time of displaying an image on the display unit 108 and indicates a correspondence relation between brightness at a specific position in the screen 108A of the display unit 108, and the gradation of the image signal. The display control unit 107 corrects the image signal by using the gradation correction map. The uncorrected brightness is brightness at a first time point before a second time point.

A rotation unevenness correction amount is a correction amount for correcting an unevenness characteristic difference, being a difference between display unevenness of each pixel at a reference angle value and display unevenness at each position at the time of rotating a display screen by a predetermined rotation angle value, and is a brightness ratio or brightness difference value. Moreover, the rotation unevenness correction amount is generally an independent value for each rotation angle, for each color (for example, R (red), G (green), and B (blue)), for each gradation (for example, 255/192/128/64/0), and for each position. The respective positions in the screen 108A of the display unit 108 correspond to each of a plurality of pixels, which are less than the whole pixels of the screen 108A, and are for example, positions of respective points of 20 points horizontally by 11 points vertically, which are obtained by dividing the pixels of the screen 108A of the display unit 108.

The image input unit 106 inputs the image signal.

The display control unit 107 corrects the image signal by using the gradation correction map.

The display unit 108 can be rotated (freely rotatable) parallel to a display surface, and includes a screen 108A to display an image corresponding to the corrected image signal. That is to say, for example, the display unit 108 can be rotated to a rotation angle, which becomes horizontal installation with the display surface being horizontally long, or vertical installation with the display surface being vertically long.

The rotation unevenness correction map is a set of data indicating the correspondence relation between; brightness values corrected by the rotation unevenness correction amount generated based on the brightness unevenness map and the rotation unevenness map at respective positions in the screen 108A of the display unit 108, and the respective positions in the screen 108A of the display unit 108.

The user-measured gamma characteristic indicates a correspondence relation between; brightness at a specific position in the screen 108A of the display unit 108 obtained by the gamma measuring unit 111 at the second time point subsequent to the first time point, and the gradation of the image signal. The gamma characteristic is a set of data indicating a correspondence relation between; the gradation of the input image signal, and brightness of the screen 108A of the display unit 108.

The gradation correction map is a set of correction values generated based on the rotation unevenness correction map and the user-measured gamma characteristic for each specific gradation of the image signal at a specific position in the screen 108A of the display unit 108. Here it is desired from a standpoint of degree of correction of the brightness unevenness, that the specific position is one position in the screen 108A of the display unit 108, and is the same position as the position in the screen 108A of the display unit 108 obtained by measuring a basic gamma characteristic described later (first gamma characteristic). When the gradation is corrected by using the gradation correction map, brightness at the respective positions in the screen 108A of the display unit 108 is also corrected, and brightness unevenness is readjusted.

Thus, in the display apparatus 1 according to the first exemplary embodiment, the gradation correction map generating device 10 generates the gradation correction map indicating the correspondence relation between the plurality of positions in the screen 108A of the display unit 108, and the gradation correction values of the image signal at the plurality of positions. The gradation correction map generating device 10 generates the gradation correction map based on the brightness unevenness map, the rotation unevenness map, and the user-measured gamma characteristic. The brightness unevenness map indicates the correspondence relation between the plurality of positions, and the uncorrected brightness, being brightness at the time of performing no correction when the display unit 108 is installed at a predetermined angle. The rotation unevenness map indicates the correspondence relation between the plurality of positions or other plurality of positions, and a difference in brightness corresponding to the rotation angle of the display unit. The user-measured gamma characteristic indicates the correspondence relation between brightness at the specific position in the screen 108A at the second time point subsequent to the first time point, and the gradation of the image signal. The display control unit 107 corrects the image signal using the gradation correction map.

The display unit 108 includes the screen 108A to display an image corresponding to the corrected image signal. It is not required to perform correction for unevenness correction with respect to a change of the rotation angle of the display unit 108 of the display apparatus 1 at the first time point, or for unevenness correction with respect to a change of the rotation angle of the display unit 108 of the display apparatus 1 after factory shipment by the user. That is to say, according to the present exemplary embodiment, when the display unit 108 of the display apparatus 1 is rotated by a predetermined angle, because display unevenness of the image signal due to the rotation of the display unit 108 is corrected according to the gradation correction map, time-consuming individual unevenness adjustment is performed only in a representative screen direction as in the conventional method. The optical measuring instrument dedicated for measurement of the display screen, and the darkroom in which the display apparatus is arranged at the time of measurement, which have been conventionally required at the time of correcting the display unevenness, need not be prepared. Therefore, optical survey items of the display apparatus 1 can be the same as those of the conventional apparatus, and the production cost can be reduced by simplifying a production process and an adjustment process of display unevenness in a shipping inspection in a factory, being the first time point, and display unevenness of the entire screen 108A of the display unit 108 can be easily corrected in a general user environment after shipment, being an example of the second time point subsequent to the first time point.

Second Exemplary Embodiment

Hereunder, a second exemplary embodiment of the present invention will be described with reference to the drawings.

Figure 2:
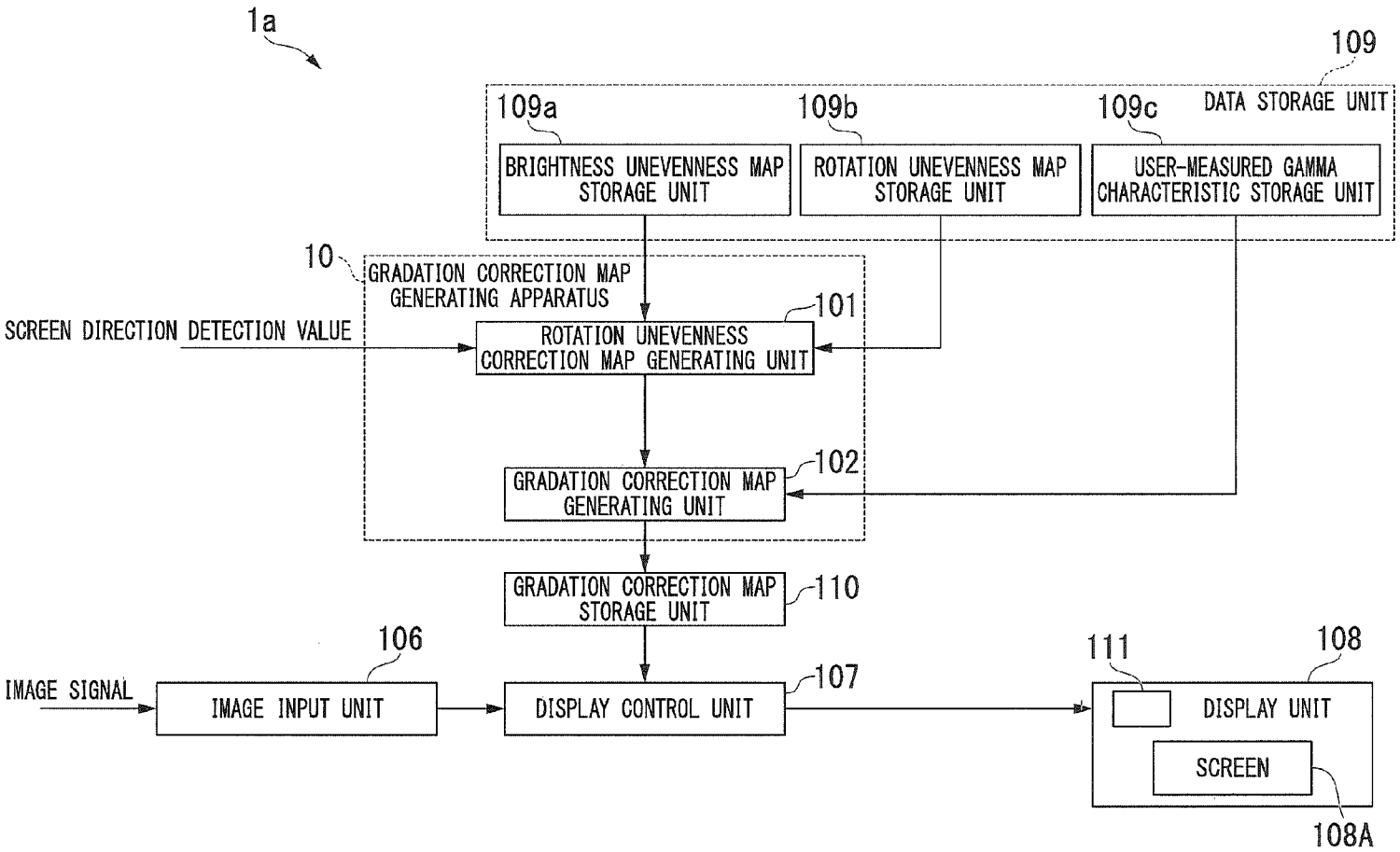
FIG. 2 is a block diagram showing a configuration example of a display apparatus according to a second exemplary embodiment of the present invention.

FIG. 2 is a block diagram showing a configuration example of a display apparatus 1*a* according to the second exemplary embodiment of the present invention. In FIG. 2, the display apparatus 1*a* includes at least a gradation correction map generating device 10, an image input unit 106, a display control unit 107, a display unit 108, a data storage unit 109, a gradation correction map storage unit 110, and a gamma measuring unit 111.

The gradation correction map generating device 10 includes a rotation unevenness correction map generating unit 101, and a gradation correction map generating unit 102. The gradation correction map generating device 10 may be an apparatus combining, for example, a microcomputer and firmware, or an FPGA (Field-Programmable Gate Array).

The gamma measuring unit 111 measures brightness at the time of displaying an image corresponding to an image signal having a predetermined gradation, on a screen 108A.

The data storage unit 109 includes a brightness unevenness map storage unit 109*a*, a rotation unevenness map storage unit 109*b*, and a user-measured gamma characteristic storage unit 109*c*. Here the data storage unit 109 is a non-volatile storage device such as a flash memory, or an EEPROM (Electrically Erasable Programmable Read-Only Memory). The brightness unevenness map at respective positions in the display unit 108 described later is written beforehand and stored in the brightness unevenness map storage unit 109*a*. The rotation unevenness map at the respective positions in the display unit 108 described later is written beforehand and stored in the rotation unevenness map storage unit 109*b*. The user-measured gamma characteristic in the display unit 108 described later is written beforehand and stored in the user-measured gamma characteristic storage unit 109*c*.

The rotation unevenness correction map generating unit 101 multiplies the rotation unevenness map by the brightness unevenness map to generate the rotation unevenness correction map.

Here the brightness unevenness map is stored in the brightness unevenness map storage unit 109*a*, and is generated based on a gradation correction basic map and a basic gamma characteristic. The gradation correction basic map indicates a correspondence relation between a plurality of positions in a screen 108A of the display unit 108, and gradation correction values of an image signal at the positions. The basic gamma characteristic is measured at the time of production or shipping inspection in the factory, and indicates a correspondence relation between brightness at a specific position or near the specific position on the screen 108A of the display unit 108, and a gradation of the image signal at the plurality of positions.

The rotation unevenness map indicates a correspondence relation between an unevenness characteristic difference in display unevenness in a state with the screen 108A of the display apparatus 1 being at a reference angle value (for example, at the time of horizontal installation) and in a rotated state with a predetermined rotation angle (for example, at the time of vertical installation rotated by 90 degrees), and the respective positions of the display unit 108. Horizontal installation means an angle of the display apparatus such that there are 768 pixels in the vertical direction in the display screen 108A of the display unit 108 and 1024 pixels in the horizontal direction when the number of pixels is 1024 by 768 pixels. On the other hand, vertical installation means an angle of the display apparatus such that the screen 108A is rotated by 90 degrees (or −90 degrees) with respect to the screen 108A at the time of horizontal installation, and there are 1024 pixels in the vertical direction in the display screen 108A of the display unit 108 and 768 pixels in the horizontal direction.

The display unevenness characteristic is caused by a change of temperature distribution in the screen 108A of the display unit 108, and is approximately decided by the casing structure of the display apparatus 1. Consequently, because commonality between individual liquid crystal panels is high, there are only minute changes between the liquid crystal panels. As a result, the rotation unevenness map is decided at the time of product development as a common value between the respective liquid crystal panels having a small data amount, and is written and stored beforehand in the rotation unevenness map storage unit 109*b*.

Moreover, when there is no data of the rotation unevenness map corresponding to the position in the screen 108A of the display unit 108, the rotation unevenness correction map generating unit 101 reflects the data in which the data of the rotation unevenness map is interpolated by linear interpolation, with respect to the brightness unevenness map.

The gradation correction map generating unit 102 generates the gradation correction map based on the rotation unevenness correction map generated by the rotation unevenness correction map generating unit 101, and the user-measured gamma characteristic stored in the user-measured gamma characteristic storage unit 109*c*.

For example, the gradation correction map generating unit 102 converts the brightness to be displayed after correction using a rotation unevenness correction amount constituting the rotation unevenness correction map, to the gradation by referring to the user-measured gamma characteristic. Moreover, the gradation correction map generating unit 102 obtains a gradation correction value based on the converted gradation to calculate the gradation correction map. The gradation correction map generating unit 102 writes and stores the generated gradation correction map in the gradation correction map storage unit 110.

The gradation correction map storage unit 110 stores various pieces of data required for a process of the display control unit 107. For example, the gradation correction map storage unit 110 may be constituted by a volatile storage device such as a RAM (Random Access Memory), and stores the gradation correction map.

The image input unit 106 inputs the image signal. The image input unit 106 outputs the input image signal to the display control unit 107.

The display control unit 107 corrects the gradation of the image signal input from the image input unit 106 based on the gradation correction map stored in the gradation correction map storage unit 110. The display control unit 107 displays the image on the display unit 108 by using the corrected image signal.

The display unit 108 includes the gamma measuring unit 111 that measures the brightness at the time of displaying the image corresponding to the image signal of the predetermined gradation on the screen 108A.

FIG. 3 is a diagram showing an example of data of the gradation correction basic map.

As shown in FIG. 3, the gradation correction basic map is a set of gradation correction values for correcting brightness unevenness for each of a plurality of gradations and for each of a plurality of positions. The gradation correction basic map indicates gradation correction values for eliminating brightness unevenness measured at the first time point at the time of production or factory shipment. For example, as shown in FIG. 3, a plurality of gradations is gradations 255, 192, 128, 64, and 0 obtained by adding 64 gradations to 0 sequentially up to gradation 255. Moreover, the plurality of positions are positions on the screen 108A indicated by a combination of the x coordinate and the y coordinate, taking 20 x coordinates in an X-axis direction and 11 y coordinates in a Y-axis direction at regular intervals, designating a coordinate at the upper left corner of the screen 108A of the display unit 108 as an origin.

The gradation correction value may be a value indicated by an absolute value with respect to the respective gradations, or may be a value indicated by a gradation value to be subtracted from the respective gradations. For example, it is assumed that the gradation correction value shown in FIG. 3 is the value indicated by the absolute value. In this case, at the gradation 255, the gradation correction value at a position in the screen 108A of the display unit 108 indicated by x1 on the x coordinate and y1 on the y coordinate, is a correction value to change the gradation 255 to gradation 230. When the gradation correction value is the value indicated by the gradation value subtracted from the respective gradations, and the same correction is performed, then at the gradation 255, the gradation correction value at the position in the screen 108A of the display unit 108 indicated by x1 on the x coordinate and y1 on the y coordinate is gradation −25.

Moreover, the gradation correction basic map may be created with respect to each single color of R (Red), G (Green), and B (Blue). If the gradation correction basic map created in this manner is used, brightness unevenness and color unevenness on the screen 108A of the display unit 108 can be corrected. Furthermore, the gradation correction basic map may be created with respect to a single color of monochrome. If the gradation correction basic map created in this manner is used, only brightness unevenness on the screen 108A of the display unit 108 can be corrected.

Figure 4:
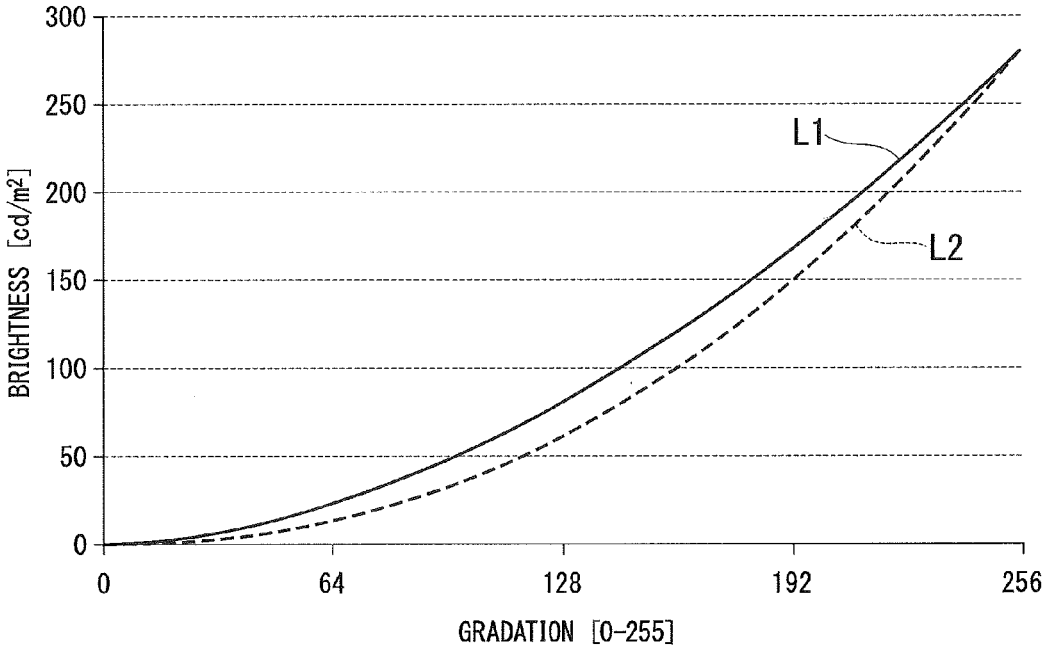
FIG. 4 is a diagram showing an example of a basic gamma characteristic and a user-measured gamma characteristic, in the second exemplary embodiment of the present invention.

FIG. 4 is a diagram showing an example of the basic gamma characteristic and the user-measured gamma characteristic. A slide line L1 indicates a basic gamma characteristic. A dashed line L2 indicates a user-measured gamma characteristic.

In FIG. 4, the horizontal axis denotes the gradation of the image signal. Furthermore, the vertical axis denotes brightness.

The gamma characteristic is data indicating a correspondence relation between the gradation of the input image signal, and brightness of the screen 108A of the display unit 108.

The basic gamma characteristic is a gamma characteristic at the respective positions in the screen 108A of the display unit 108 at the first time point before the second time point (at the time of production or shipping inspection in the factory in which the gradation correction basic map has been created). That is to say, the basic gamma characteristic indicates the basic gamma characteristic shown in FIG. 4 with respect to a specific position in the screen 108A of the display unit 108. The second time point indicates a time point after the first time point at which the gradation correction basic map has been created, and includes a time point at which a user has obtained the gradation correction basic map. Moreover, the user-measured gamma characteristic is a gamma characteristic obtained by measuring brightness at the specific position in the screen 108A of the display unit 108, which is obtained after the time point of shipping inspection, that is, a time point when the user uses the display apparatus 1*a* after shipment. That is to say, the user-measured gamma characteristic indicates the gamma characteristic shown in FIG. 4 with respect to the specific position in the screen 108A of the display unit 108 measured by the user at the second time point subsequent to the first time point. Here the user-measured gamma characteristic may be the gamma characteristic measured by the user with respect to one position in the screen 108A of the display unit 108. It is desired from a standpoint of the degree of correction of the brightness unevenness, that the position in the screen 108A of the display unit 108 at which the user measures the user-measured gamma characteristic, is the same position as the position in the screen 108A of the display unit 108 where the basic gamma characteristic has been measured.

Figure 5:
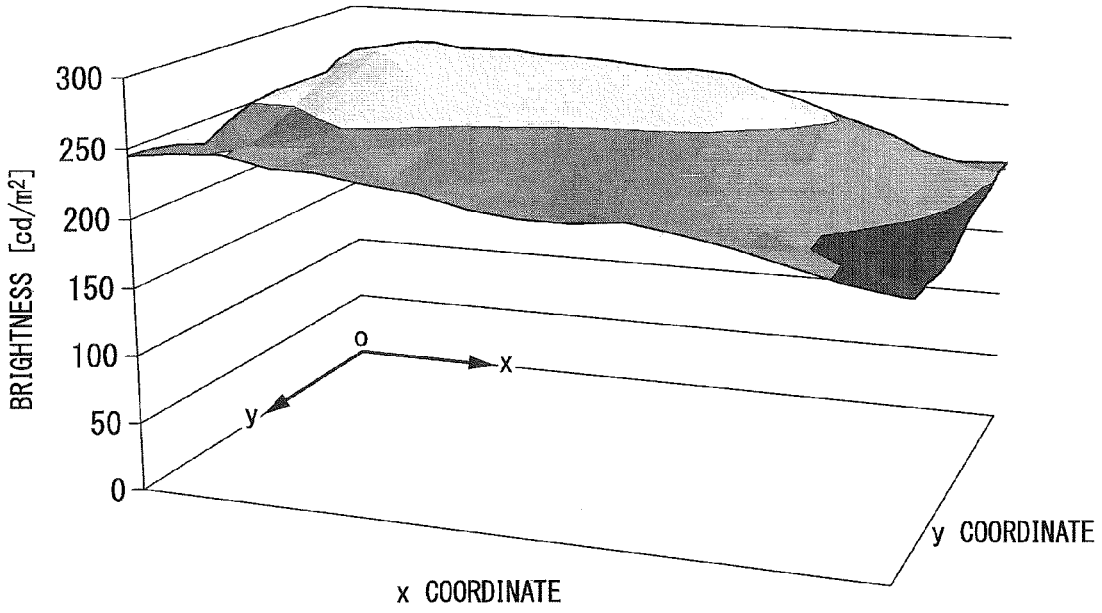
FIG. 5 is a diagram showing an example of a brightness unevenness map, in the second exemplary embodiment of the present invention.

FIG. 5 shows an example of the brightness unevenness map.

In FIG. 5, the X-axis corresponds to a coordinate axis in the horizontal direction of the screen 108A of the display unit 108. Furthermore, the Y-axis corresponds to a coordinate axis in the vertical direction of the screen 108A of the display unit 108. The origin corresponds to at the upper left corner of the screen 108A of the display unit 108, and the x coordinate and the y coordinate correspond to coordinates on the screen 108A of the display unit 108. Moreover, the brightness indicates brightness at the position on the screen 108A indicated by the x coordinate and the y coordinate.

The brightness unevenness map is a set of data indicating brightness at the respective positions in the screen 108A of the display unit 108 at the first time point before the second time point at which the gradation correction basic map shown in FIG. 3 and the basic gamma characteristic shown in FIG. 4 have been created. Generally, when the display unit 108 is a liquid crystal panel, as shown in FIG. 5, a center of the screen 108A tends to be brighter.

The brightness unevenness map is calculated based on the gradation correction basic map and the basic gamma characteristic.

In FIG. 5, the brightness unevenness map is visually shown. However, the brightness unevenness map is actually not image data but is a data table, and is written and stored in the brightness unevenness map storage unit 109*a* as data of brightness associated with the x coordinate and the y coordinate as in the gradation correction basic map shown in FIG. 3.

Figure 6:
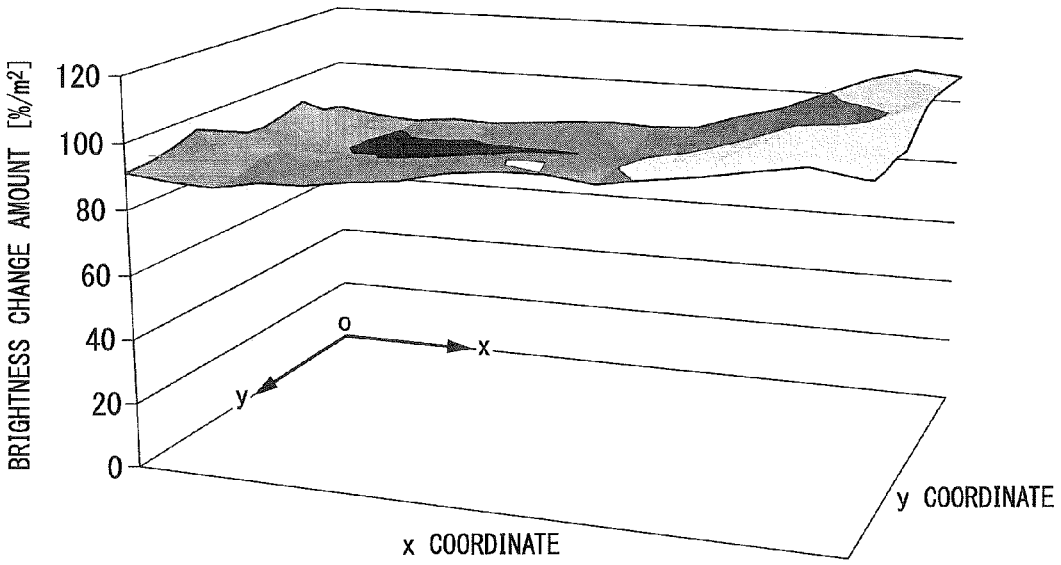
FIG. 6 is a diagram showing an example of a rotation unevenness map, in the second exemplary embodiment of the present invention.

FIG. 6 is a diagram showing an example of the rotation unevenness map.

In FIG. 6, the X-axis corresponds to a coordinate axis in the horizontal direction of the screen 108A of the display unit 108. Furthermore, the Y-axis corresponds to a coordinate axis in the vertical direction of the screen 108A of the display unit 108. The origin corresponds to at the upper left corner of the screen 108A of the display unit 108 before the display unit 108 of the display apparatus 1 is rotated by 90 degrees, and the x coordinate and the y coordinate corresponds to coordinates on the screen 108A of the display unit 108. The rotation unevenness correction amount is an unevenness characteristic difference of display unevenness, and indicates a change amount of brightness unevenness of a brightness value at a position on the screen 108A indicated by the x coordinate and the y coordinate.

That is to say, when it is assumed that in the respective positions of the display screen 108A of the display unit 108, the brightness value in an area in which there is hardly a temperature change even if the display unit 108 is rotated as compared to the state for the reference angle value, and that has the same brightness value as the brightness value in the state of the display unit 108, is set as a reference value (100%), the rotation unevenness correction amount indicates a ratio of the brightness value in percentage in another area that has been changed with respect to the reference value. As seen from FIG. 6, by rotating the display unit 108 by 90 degrees, the brightness value increases at a position of the screen 108A of the display unit 108 having been changed from a bottom part to a top part (the brightness value exceeds 100% of the reference value). On the other hand, the brightness value decreases at a position of the screen 108A of the display unit 108 having been changed from the top part to the bottom part (the brightness value is below 100% of the reference value).

In FIG. 6, the rotation unevenness map is visually shown. However, the rotation unevenness map is actually not the image data, but is a data table. The rotation unevenness map is written and stored in the rotation unevenness map storage unit 109*b* as the brightness data associated with the x coordinate and the y coordinate as in the gradation correction basic map shown in FIG. 3.

FIG. 7 is a diagram showing an example of data of the gradation correction map.

As shown in FIG. 7, the gradation correction map is a set of gradation correction values for correcting brightness unevenness for each of a plurality of gradations and for each of a plurality of positions.

The gradation correction map indicates gradation correction values in order to reduce temporal brightness unevenness before and after rotation of the display unit 108 of the display apparatus 1*a*, and brightness unevenness due to a change of ambient temperature of the display apparatus 1*a*, at the second time point subsequent to the first time point. For example, as shown in FIG. 7, a plurality of gradations is gradations 255, 192, 128, 64, and 0 obtained by adding 64 gradations to 0 sequentially up to gradation 255. Moreover, the plurality of positions are positions on the screen 108A indicated by a combination of the x coordinate and the y coordinate, taking 20 x coordinates in the x-axis direction and 11 y coordinates in the y-axis direction at regular intervals, designating a coordinate at the upper left corner of the screen 108A of the display unit 108 as an origin.

The gradation correction map generating unit 102 generates the gradation correction map based on the user-measured gamma characteristic and the rotation unevenness correction map. The user-measured gamma characteristic is a gamma characteristic measured by the user with respect to a specific position in the screen 108A of the display unit 108 at the second time point subsequent to the first time point at the time of production, factory adjustment, or the like. For example, the user-measured gamma characteristic is obtained by using the gamma measuring unit 111 provided in the display unit 108 by a user operation to read a test pattern of the image displayed on a part of the screen 108A of the display unit 108. That is to say, the gamma measuring unit 111 reads the test pattern of the image. Here the gamma measuring unit 111 may be incorporated in the display unit 108 or may be provided in the frame of the display unit 108 and appear outside of the frame at the time of use. Moreover, the gamma measuring unit 111 may extend from a rear surface of the display unit 108, or may be an external device and not provided in the display unit 108.

The gradation correction value may be a value indicated by an absolute value with respect to the respective gradations, or may be a value indicated by a gradation value to be subtracted from the respective gradations.

Moreover, the gradation correction map may be created with respect to each single color of R (Red), G (Green), and B (Blue). If the gradation correction map created in this manner is used, brightness unevenness and color unevenness on the screen 108A of the display unit 108 can be corrected.

Furthermore, the gradation correction map may be created with respect to a single color of monochrome. If the gradation correction map created in this manner is used, display unevenness and brightness unevenness on the screen 108A of the display unit 108 can be corrected.

Figure 8:
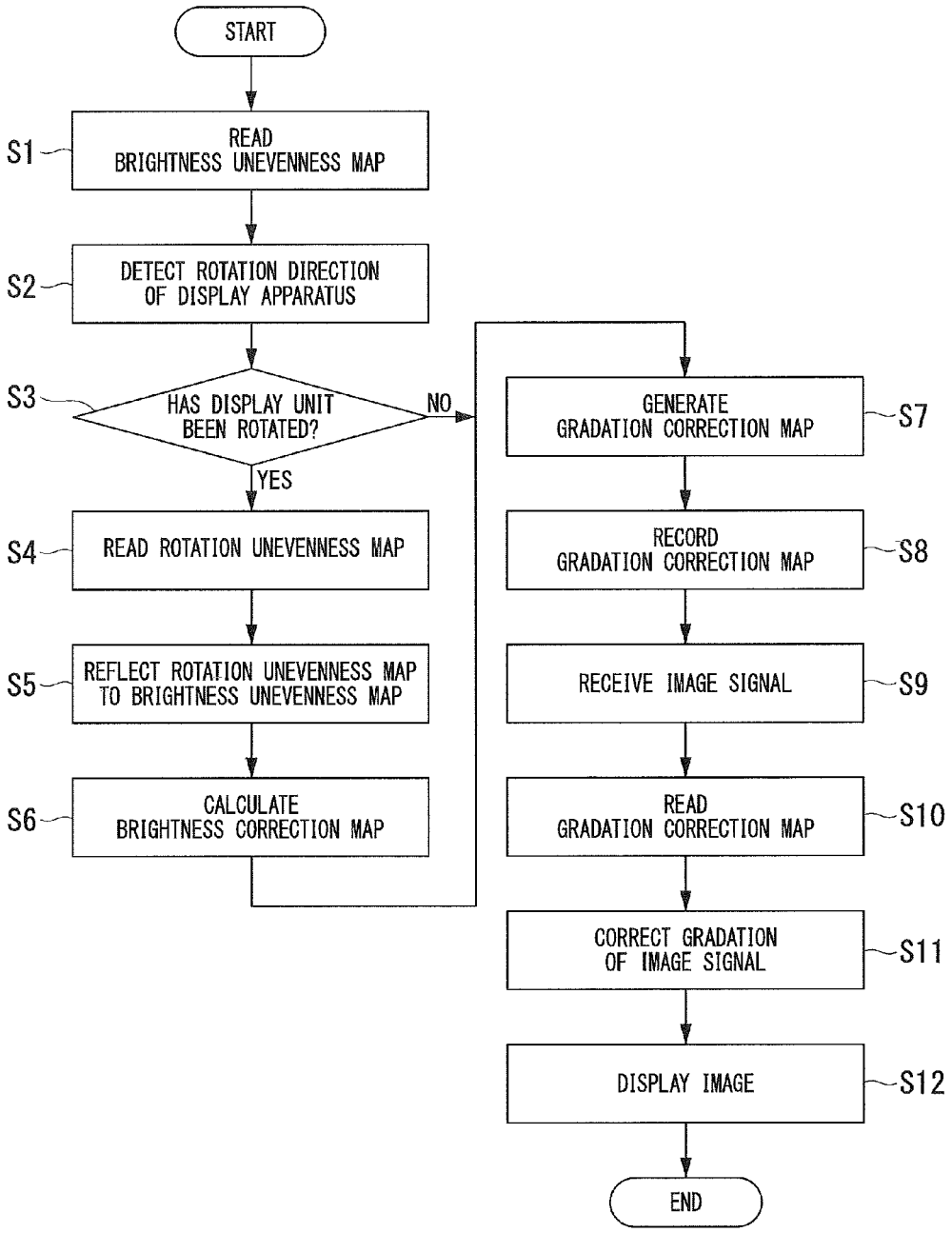
FIG. 8 is a flowchart showing an operation example of displaying an image signal by the display apparatus according to the second exemplary embodiment of the present invention.

FIG. 8 is a flowchart showing an operation example in which an image signal is displayed by the display apparatus 1*a* according to the second exemplary embodiment of the present invention.

A separate external apparatus different from the display apparatus 1*a* (for example, a personal computer) captures brightness unevenness generated on the screen 108A of the display unit 108 by a high-precision camera or the like at the time of production, factory adjustment, or the like. The external apparatus obtains the respective positions in the screen 108A of the display unit 108 and brightness at the respective positions. The external apparatus specifies the gradation correction basic map that reproduces brightness unevenness captured by the high-precision camera or the like, and the basic gamma characteristic at the time point, based on the obtained brightness.

For example, the external apparatus may specify the gradation correction basic map and the basic gamma characteristic that reproduce brightness unevenness indicating a correspondence relation between the respective positions in the screen 108A of the display unit 108 when a white single color image signal is input at the time of production or factory adjustment being the first time point, and brightness at the respective positions.

The external apparatus creates the brightness unevenness map based on the specified gradation correction basic map and basic gamma characteristic, and writes and stores the brightness unevenness map in the brightness unevenness map storage unit 109*a*.

Moreover, the external apparatus measures the brightness values at the respective positions of the display unit 108 in the state of being at the reference angle value, and also measures the brightness values at the respective positions of the display unit 108 after being rotated by a predetermined angle, to obtain a brightness change amount at each position, thereby creating the rotation unevenness map. The external apparatus writes and stores the created rotation unevenness map in the rotation unevenness map storage unit 109*b*.

Furthermore the user-measured gamma characteristic measured by the user (measured by the gamma measuring unit 111) at the second time point subsequent to the first time point is stored in the user-measured gamma characteristic storage unit 109*c*. The user-measured gamma characteristic is the gamma characteristic measured by the user at the second time point subsequent to the first time point. For example, the display unit 108 reads the test pattern of the image to be displayed on a part of the screen 108A of the display unit 108 by user operation using the gamma measuring unit 111 provided in the display unit 108, to obtain the user-measured gamma characteristic. Here the gamma measuring unit 111 may be incorporated in the display unit 108 or may be provided in the frame of the display unit 108 and appear outside of the frame at the time of use. Moreover, the gamma measuring unit 111 may extend from the rear surface of the display unit 108, or may be an external device and not provided in the display unit 108. It is desired from a standpoint of the degree of correction of the display unevenness, that the position in the screen 108A of the display unit 108 at which the user measures the user-measured gamma characteristic, is the same position as the position in the screen 108A of the display unit 108 where the basic gamma characteristic has been measured.

The rotation unevenness correction map generating unit 101 reads the brightness unevenness map from the brightness unevenness map storage unit 109*a* (step S1).

The rotation unevenness correction map generating unit 101 reads a screen direction detection value indicating a rotation angle from the state with the display unit 108 being at the reference angle value (for example, the state of horizontal installation), from an angle detection unit (not shown) provided in the display unit 108 (step S2).

The rotation unevenness correction map generating unit 101 determines whether the display unit 108 has been rotated from the reference angle value, based on the screen direction detection value read from the angle detection unit (step S3). At this time, if the display unit 108 has been rotated from the reference angle value, the process proceeds to step S4. On the other hand, if the display unit 108 is in the state of being at the reference angle value, the process proceeds to step S7. Here if the display unit 108 is in the state of being at the reference angle value, the rotation unevenness correction map generating unit 101 designates the brightness unevenness map as the rotation unevenness correction map, and the process proceeds to step S7.

Subsequently, the rotation unevenness correction map generating unit 101 reads the rotation unevenness map from the rotation unevenness map storage unit 109*b* (step S4). Here if the rotation unevenness map is stored in the rotation unevenness map storage unit 109*b* for each type of rotation angles, the rotation unevenness correction map generating unit 101 reads the rotation unevenness map corresponding to the rotation angle indicated by the screen direction detection value, from the rotation unevenness map storage unit 109*b*.

The rotation unevenness correction map generating unit 101 then reflects the respective change amounts of the brightness values in the rotation unevenness map with respect to the brightness values at the respective positions in the brightness unevenness map, based on the read brightness unevenness map and rotation unevenness map, and obtains the brightness value with display unevenness at each position having been corrected by the rotation unevenness correction amount (step S5). That is to say, the rotation unevenness correction map generating unit 101 multiplies the brightness value in the brightness unevenness map by the rotation unevenness correction amount in the rotation unevenness map for each corresponding position of the display unit 108, and calculates the brightness value corrected by the rotation unevenness correction amount.

The rotation unevenness correction map generating unit 101 generates the rotation unevenness correction map using the brightness value corrected by the rotation unevenness correction amount at each position in the screen 108A of the display unit 108, obtained based on the read brightness unevenness map and rotation unevenness map (step S6).

The gradation correction map generating unit 102 reads the rotation unevenness correction map from the rotation unevenness correction map generating unit 101, and reads the data of the user-measured gamma measurement characteristic from the user-measured gamma characteristic storage unit 109*c*. Here if the display unit 108 includes the gamma measuring unit 111 that reads the test pattern of the image, the display unit 108 may display the test pattern of the image at a position on the screen 108A corresponding to the position of the gamma measuring unit 111.

The gradation correction map generating unit 102 converts the brightness value corrected by the rotation unevenness correction amount in the input rotation unevenness correction map, to the gradation by using the user-measured gamma characteristic read from the user-measured gamma characteristic storage unit 109*c* to generate the gradation correction map (step S7).

The gradation correction map generating unit 102 writes and stores the generated gradation correction map in the gradation correction map storage unit 110 (step S8).

The image input unit 106 receives an image signal from the external apparatus (step S9). The image input unit 106 outputs the received image signal to the display control unit 107.

Upon reception of the image signal from the image input unit 106, the display control unit 107 reads the gradation correction map from the gradation correction map storage unit 110 (step S10).

The display control unit 107 uses the gradation correction may read from the gradation correction map storage unit 110 to correct the gradation of the received image signal for each pixel on the display screen 108A of the display unit 108, matched with the respective positions of the display unit 108 in the gradation correction map (step S11).

The display control unit 107 causes the display unit 108 to display the image on the display screen 108A by using the corrected image signal (step S12).

The process of the display apparatus 1*a* according to the second exemplary embodiment of the present invention has been described above.

As described above, the display apparatus 1*a* according to the second exemplary embodiment includes at least the gradation correction map generating device 10, the image input unit 106, the display control unit 107, the display unit 108, the data storage unit 109, the gradation correction map storage-unit 110, and the gamma measuring unit 111. Moreover, the gradation correction map generating device 10 includes the rotation unevenness correction map generating unit 101 and the gradation correction map generating unit 102. The data storage unit 109 includes the brightness unevenness map storage unit 109*a*, the rotation unevenness map storage unit 109*b*, and the user-measured gamma characteristic storage unit 109*c*.

The rotation unevenness correction map generating unit 101 calculates the rotation unevenness correction map based on the brightness unevenness map stored in the brightness unevenness map storage unit 109*a*, and the rotation unevenness map stored in the rotation unevenness map storage unit 109*b*. Furthermore, the gradation correction map generating unit 102 can easily generate the gradation correction map based on the rotation unevenness correction map obtained by the rotation unevenness correction map generating unit 101, and the user-measured gamma characteristic measured at the second time point subsequent to the first time point, and can record the gradation correction map in the gradation correction map storage unit 110.

Moreover, the display control unit 107 corrects the gradation of the image signal input from the image input unit 106, based on the gradation correction map stored in the gradation correction map storage unit 110, so that the image is displayed on the display unit 108.

As a result, the display apparatus 1*a* according to the second exemplary embodiment need not perform correction for unevenness correction with respect to a change of the rotation angle of the display unit 108 of the display apparatus 1*a* at the first time point at which production or shipping inspection is performed in the factory, or for unevenness correction with respect to a change of the rotation angle of the display unit 108 of the display apparatus 1*a* after factory shipment by the user. That is to say, according to the present exemplary embodiment, when the display unit 108 of the display apparatus 1*a* is rotated by a predetermined angle, display unevenness of the image signal due to the rotation of the display unit 108 is corrected according to the gradation correction map. Therefore time-consuming individual unevenness adjustment is performed only in a representative screen direction as in the conventional method. The optical measuring instrument dedicated for measurement of the display screen, and optical survey items of the display apparatus 1 can be the same as those of the conventional apparatus. Moreover, the darkroom in which the display apparatus is arranged at the time of measurement, which has been conventionally required at the time of correcting the display unevenness, need not be prepared. Therefore, optical survey items of the display apparatus 1*a* can be the same as those of the conventional apparatus. The production cost can be reduced by simplifying the production process and the adjustment process of display unevenness in the shipping inspection in the factory, being the first time point, and display unevenness of the entire screen of the display unit 108 can be easily corrected in the general user environment at the second time point subsequent to the first time point.

Moreover the display apparatus 1*a* according to the second exemplary embodiment corrects the gradation based on the user-measured gamma characteristic at a specific position in the screen 108A of the display unit 108, thereby enabling to correct display unevenness of the entire screen 108A of the display unit 108 easily.

Moreover, the brightness unevenness map storage unit 109*a* stores the gradation correction basic map for each of R, G, and B, and the gradation correction map generating device 10 generates the gradation correction map based on the gradation correction basic map of respective R, G, and B.

Accordingly, the display apparatus 1*a* according to the second exemplary embodiment can realize display performance that reproduces a uniform color without display unevenness on the entire screen 108A of the display unit 108.

Third Exemplary Embodiment

Hereunder, a third exemplary embodiment of the present invention will be described with reference to the drawings.

Figure 9:
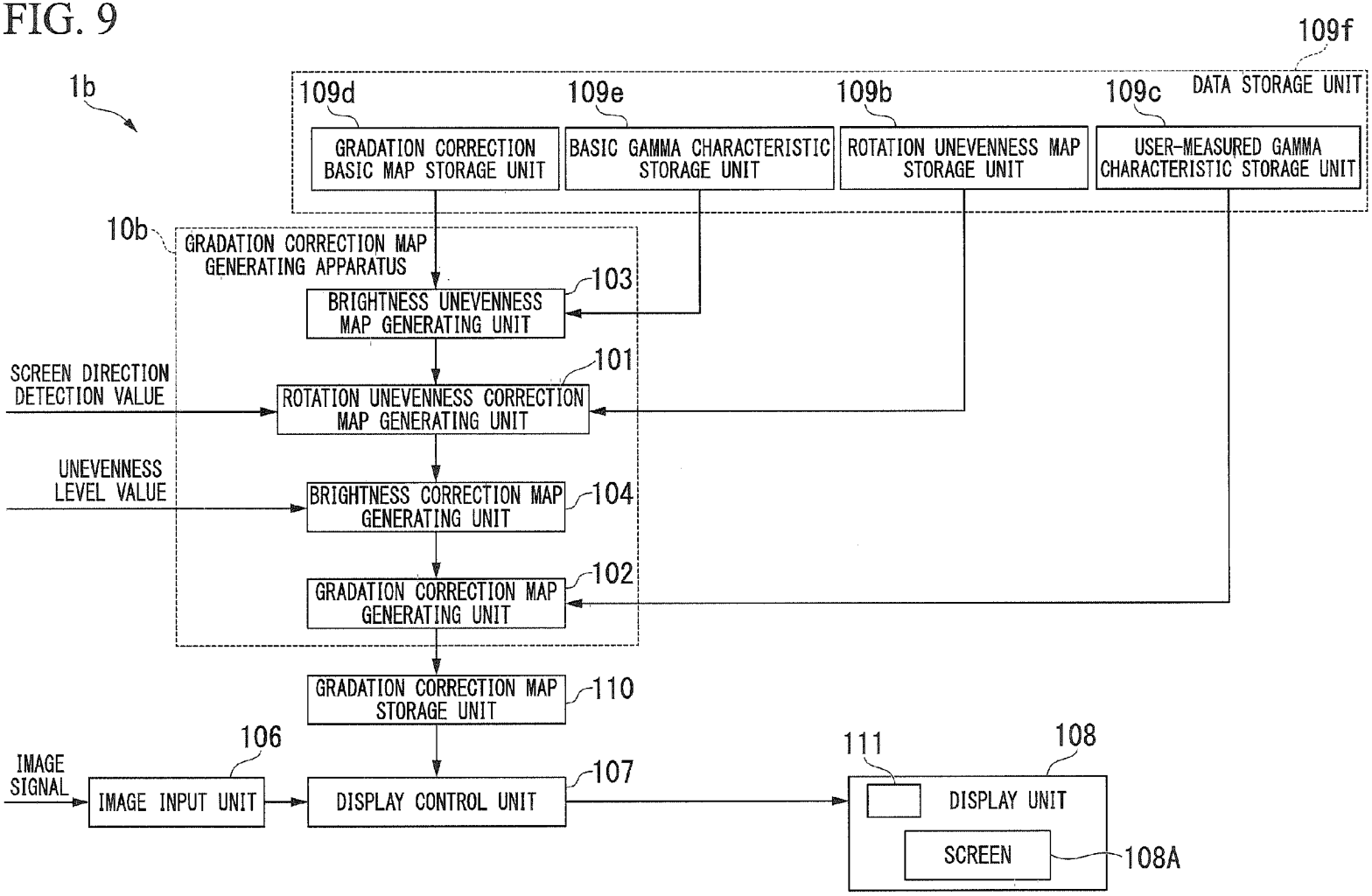
FIG. 9 is a block diagram showing a configuration example of a display apparatus according to a third exemplary embodiment of the present invention.

FIG. 9 is a block diagram showing a configuration example of a display apparatus 1*b* according to the third exemplary embodiment of the present invention. In FIG. 9, the display apparatus 1*b* includes at least a gradation correction map generating apparatus 10*b*, an image input unit 106, a display control unit 107, a display unit 108, a data storage unit 109*f*, a gradation correction map storage unit 110, and a gamma measuring unit 111. The gradation correction map generating apparatus 10*b* may be referred to as the gradation correction map generating device 10*b*. Configuration similar to that of the second exemplary embodiment in FIG. 2 is denoted by the same reference symbols. Configuration and operation different from that of the second exemplary embodiment will be described below.

The gradation correction map generating device 10*b* includes a rotation unevenness correction map generating unit 101, a gradation correction map generating unit 102, a brightness unevenness map generating unit 103, and a brightness correction map generating unit 104. For example, the gradation correction map generating device 10*b* is an apparatus combining, for example, a microcomputer and firmware, or an FPGA (Field-Programmable Gate Array).

A gradation correction basic map is written and stored beforehand in a gradation correction basic map storage unit 109*d*.

A basic gamma characteristic of the display unit 108 is written and stored beforehand in a basic gamma characteristic storage unit 109*e*.

The brightness unevenness map generating unit 103 generates a brightness unevenness map based on the gradation correction basic map stored in the gradation correction basic map storage unit 109*d*, and the basic gamma characteristic stored in the basic gamma characteristic storage unit 109*e*.

When there is no data of the gradation correction basic map and no data of the basic gamma characteristic corresponding to positions in the screen 108A of the display unit 108, the brightness unevenness map generating unit 103 converts gradation to brightness by using data in which the data of the gradation correction basic map and the data of the basic gamma characteristic are interpolated by linear interpolation.

Moreover the brightness unevenness map generating unit 103 converts gradation that has been corrected by using a gradation correction value of the gradation provided in the gradation correction basic map, to brightness, by referring to the basic gamma characteristic to calculate the brightness unevenness map. Here the brightness unevenness map indicates a correspondence relation between the respective positions in the screen 108A of the display unit 108 at the time of non-correction, and uncorrected brightness, being brightness at the time of non-correction at the respective positions.

The rotation unevenness correction map generating unit 101 generates a rotation unevenness correction map including brightness values in which the brightness unevenness map generated by the brightness unevenness map generating unit 103 is reflected in a rotation unevenness correction amount in the rotation unevenness map stored in the rotation unevenness map storage unit 109*b*. Generation of the rotation unevenness correction map is the same as that of the second exemplary embodiment.

The brightness correction map generating unit 104 calculates a target brightness unevenness map corresponding to an unevenness level value, based on the rotation unevenness correction map calculated by the rotation unevenness correction map generating unit 101. Here the unevenness level value is a parameter expressing how much correction of the gradation of the image signal is to be performed. The unevenness level value may be also selected arbitrarily by the user. A range of the unevenness level value is, for example, from 0 percent (non-correction) to 100 percent (complete correction). The target brightness unevenness map is a brightness unevenness map indicating brightness at the respective positions in the screen 108A of the display unit 108 to be targeted in correction of the gradation of the image signal (target brightness). For example, when the unevenness level value is 0 percent (non-correction), the target brightness unevenness map is the same as the brightness unevenness map calculated by the brightness unevenness map generating unit 103. Furthermore the target brightness held in the target brightness unevenness map when the unevenness level value is 100 percent (complete correction) is the same as the lowest brightness in the brightness unevenness map calculated by the brightness unevenness map generating unit 103. Moreover, the target brightness held in the target brightness unevenness map when the unevenness level value is a value between 0 percent and 100 percent is set to be a value between the target brightness when the unevenness level value is 0 percent and the target brightness when the unevenness level value is 100 percent.

The brightness correction map generating unit 104 calculates the brightness correction amount based on the rotation unevenness correction map calculated by the rotation unevenness correction map generating unit 101 and the calculated target brightness unevenness map. The brightness correction amount is a difference or a ratio between brightness held in the brightness unevenness map and target brightness held in the target brightness unevenness map. For example, if the brightness held in the brightness unevenness map is 250 [candela per square meter] and the target brightness held in the target brightness unevenness map is 200 [candela per square meter], the brightness correction amount is 50 (=250−200) [candela per square meter] or 80 (=100×(200/250)) percent. The brightness correction map generating unit 104 generates the brightness correction map by using the calculated brightness correction amount.

The gradation correction map generating unit 102 generates the gradation correction map based on the brightness correction map generated by the brightness correction map generating unit 104 and the user-measured gamma characteristic stored in the user-measured gamma characteristic storage unit 109*c*. For example, the gradation correction map generating unit 102 calculates brightness to be displayed after correction by using the brightness correction amount constituting the brightness correction map, and converts the brightness to the gradation by referring to the user-measured gamma characteristic. Furthermore the gradation correction map generating unit 102 obtains-a correction amount of the gradation based on the converted gradation to calculate the gradation correction map. The gradation correction map generating unit 102 writes and stores the generated gradation correction map in the gradation correction map storage unit 110.

Figure 10:
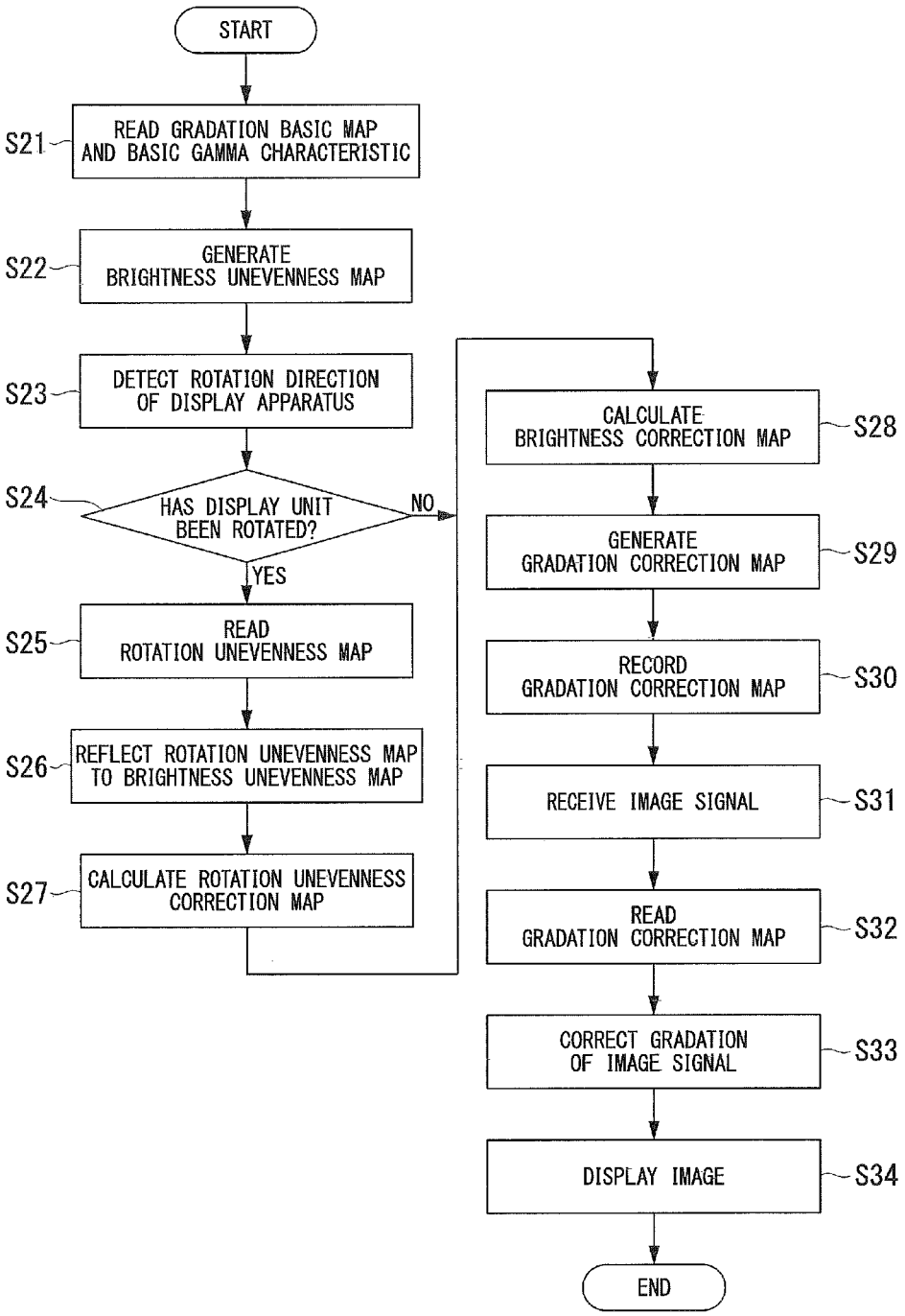
FIG. 10 is a flowchart showing an operation example of displaying an image signal by the display apparatus according to the third exemplary embodiment of the present invention.

FIG. 10 is a flowchart showing an operation example in which an image signal is displayed by the display apparatus 1*b* according to the third exemplary embodiment of the present invention.

A separate external apparatus different from the display apparatus 1*b* captures brightness unevenness generated on the screen 108A of the display unit 108 by a high-precision camera or the like at the time of shipping inspection in the factory, as in the second exemplary embodiment, to obtain the respective positions in the screen 108A of the display unit 108 and brightness at the respective positions. The external apparatus specifies the gradation correction basic map that reproduces brightness unevenness captured by the high-precision camera or the like, and the basic gamma characteristic at the time point, based on the obtained brightness.

For example, the external apparatus specifies the gradation correction basic map and the basic gamma characteristic that reproduce brightness unevenness indicating a correspondence relation between the respective positions in the screen 108A of the display unit 108 when a white single color image signal is input at the time of production or shipping inspection in the factory, and brightness at the respective positions.

The external apparatus writes and stores the specified gradation correction basic map and basic gamma characteristic respectively in the gradation correction basic map storage unit 109*d* and the basic gamma characteristic storage unit 109*e*.

The brightness unevenness map generating unit 103 reads the gradation correction basic map from the gradation correction basic map storage unit 109*d*, and reads the basic gamma characteristic from the basic gamma characteristic storage unit 109*e* (step S21).

The brightness unevenness map generating unit 103 converts the gradation at the respective positions in the screen 108A of the display unit 108 to brightness, based on the read gradation correction basic map and basic gamma characteristic.

The brightness unevenness map generating unit 103 calculates the brightness unevenness map based on the brightness at the respective positions in the screen 108A of the display unit 108 (step S22). For example, the brightness unevenness map is the brightness unevenness map shown in FIG. 5.

The brightness unevenness map generating unit 103 outputs the calculated brightness unevenness map to the rotation unevenness correction map generating unit 101.

The rotation unevenness correction map generating unit 101 reads a screen direction detection value indicating a rotation angle of the screen 108A from the state with the display unit 108 being at the reference angle value (for example, the state of horizontal installation), from an angle detection unit (not shown) provided in the display unit 108 (step S23).

The rotation unevenness correction map generating unit 101 determines whether the display unit 108 has been rotated from the reference angle value, based on the screen direction detection value read from the angle detection unit (step S3). At this time, if the display unit 108 has been rotated from the reference angle value, the process proceeds to step S24. On the other hand, if the display unit 108 is in the state of being at the reference angle value, the process proceeds to step S28. Here if the display unit 108 is in the state of being at the reference angle value, the rotation unevenness correction map generating unit 101 designates the brightness unevenness map as the rotation unevenness correction map, and the process proceeds to step S28.

Subsequently, the rotation unevenness correction map generating unit 101 reads the rotation unevenness map from the rotation unevenness map storage unit 109*b* (step S25). Here if the rotation unevenness map is stored in the rotation unevenness map storage unit 109*b* for each type of rotation angles, the rotation unevenness correction map generating unit 101 reads the rotation unevenness map corresponding to the rotation angle indicated by the screen direction detection value, from the rotation unevenness map storage unit 109*b*.

The rotation unevenness correction map generating unit 101 then reflects the respective change amounts of the brightness values in the rotation unevenness map with respect to the brightness values at the respective positions in the brightness unevenness map, based on the read brightness unevenness map supplied from the brightness unevenness map generating unit 103 and the rotation unevenness map read from the rotation unevenness map storage unit 109*b*, and obtains the brightness value, with display unevenness at each position having been corrected by the rotation unevenness correction amount (step S26). That is to say, the rotation unevenness correction map generating unit 101 multiplies the brightness value in the brightness unevenness map by the rotation unevenness correction amount in rotation unevenness map for each corresponding position of the display unit 108, and calculates the brightness value corrected by the rotation unevenness correction amount.

The rotation unevenness correction map generating unit 101 generates the rotation unevenness correction map by using the brightness value corrected by the rotation unevenness correction amount at each position in the screen 108A of the display unit 108, obtained based on the supplied brightness unevenness map and the read rotation unevenness map (step S27). The rotation unevenness correction map generating unit 101 outputs the rotation unevenness correction map to the brightness correction map generating unit 104.

The brightness correction map generating unit 104 receives the rotation unevenness correction map from the rotation unevenness correction map generating unit 101. Moreover the brightness correction map generating unit 104 receives the unevenness level value desired by the user. The brightness correction map generating unit 104 calculates the target brightness unevenness map in order to perform brightness unevenness correction of from 0 percent (non-correction) to 100 percent (complete correction) based on the received rotation unevenness correction map according to the unevenness level value (step S28).

For example, the brightness correction map generating unit 104 calculates the target brightness unevenness map in order to perform brightness unevenness correction of 100 percent so that brightness at the respective positions in the screen 108A of the display unit 108 shown in FIG. 5 is the same as the lowest brightness among the respective positions.

Moreover the brightness correction map generating unit 104 calculates, as the brightness correction amount at the respective positions in the screen 108A of the display unit 108, as a ratio of the target brightness unevenness map with respect to the input rotation unevenness correction map.

For example, if the received rotation unevenness correction map is 250 [candela per square meter] and target brightness unevenness map is 200 [candela per square meter], the brightness correction map generating unit 104 calculates the brightness correction amount as 80 (=100×(200/250)) percent.

The brightness correction map generating unit 104 calculates the brightness correction map, being a set of the brightness correction amounts, based on the calculated brightness correction amount at the respective positions in the screen 108A of the display unit 108.

The brightness correction map generating unit 104 outputs the calculated brightness correction map to the gradation correction map generating unit 102.

The gradation correction map generating unit 102 receives the brightness correction map from the brightness correction map generating unit 104. Moreover the gradation correction map generating unit 102 reads the user-measured gamma characteristic from the user-measured gamma characteristic storage unit 109*c*.

The gradation correction map generating unit 102 converts the brightness in the input brightness correction map, to the gradation by using the user-measured gamma characteristic read from the user-measured gamma characteristic storage unit 109*c*, to generate the gradation correction map (step S29).

The gradation correction map generating unit 102 writes and stores the generated gradation correction map in the gradation correction map storage unit 110 (step S30).

The image input unit 106 receives an image signal from the external apparatus (step S31). The image input unit 106 outputs the received image signal to the display control unit 107.

Upon reception of the image signal from the image input unit 106, the display control unit 107 reads the gradation correction map from the gradation correction map storage unit 110 (step S32).

The display control unit 107 uses the gradation correction map read from the gradation correction map storage unit 110 to correct the gradation of the received image signal (step S33).

The display control unit 107 displays the image on the display unit 108 by using the corrected image signal (step S34).

The process of the display apparatus 1*b* according to the third exemplary embodiment of the present invention has been described above. The display apparatus 1*b* includes the image input unit 106 that receives the image signal, the display control unit 107 that corrects the image signal, and the display unit 108 that has the screen 108A to display the image corresponding to the corrected image signal and is rotatable parallel to the screen 108A. The display apparatus 1*b* also includes the gradation correction map generating device 10*b* that generates the gradation correction map indicating the correspondence relation between the plurality of positions in the screen 108A, and the gradation correction values of the image signal at the plurality of positions. The gradation correction map generating device 10*b* includes the rotation unevenness correction map generating unit 101, the brightness correction map generating unit 104, and the gradation correction map generating unit 102. The rotation unevenness correction map generating unit 101 generates the rotation unevenness correction map indicating the correspondence relation between the plurality of positions and the correction values of brightness corresponding to the rotation angle of the display unit 108. The brightness correction map generating unit 104 generates the brightness correction map indicating the correspondence relation between the plurality of positions and the brightness correction amounts. The gradation correction map generating unit 102 generates the gradation correction map. The rotation unevenness correction map generating unit 101 generates the rotation unevenness correction map based on the brightness unevenness map and the rotation unevenness map. The brightness unevenness map indicates the correspondence relation between the plurality of positions and the uncorrected brightness, being brightness at the time of non-correction when the display unit 108 is installed at the predetermined angle. The rotation unevenness map indicates the correspondence relation between the plurality of positions or other plurality of positions and a difference in brightness corresponding to the rotation angle of the display unit 108. The brightness correction map generating unit 104 generates the brightness correction map based on the rotation unevenness correction map and the specified unevenness level value. The gradation correction map generating unit 102 generates the gradation correction map based on the brightness correction map and the second gamma characteristic indicating the correspondence relation between the brightness at the specific position in the screen 108A at the second time point, and the gradation of the image signal. The display control unit 107 corrects the image signal by using the gradation correction map.

The data storage unit 109*f* includes the rotation unevenness map storage unit 109*b*, the user-measured gamma characteristic storage unit 109*c*, the gradation correction basic map storage unit 109*d*, and the basic gamma characteristic storage unit 109*e*.

According to the display apparatus 1*b* described above, the brightness unevenness map generating unit 103 converts the gradation in the gradation correction basic map to brightness based on the gradation correction basic map stored in the gradation correction basic map storage unit 109*d* and the basic gamma characteristic stored in the basic gamma characteristic storage unit 109*e*. The brightness unevenness map generating unit 103 calculates the brightness unevenness map based on the data in which the gradation in the gradation correction basic map is converted to brightness. The rotation unevenness correction map generating unit 101 reflects the rotation unevenness map with respect to the brightness unevenness map to generate the rotation unevenness correction map. The brightness correction map generating unit 104 generates the brightness correction map based on the rotation unevenness map and the unevenness level value. The brightness correction map generating unit 104 calculates the target brightness unevenness map based on the rotation unevenness correction map and the unevenness level value. Moreover the brightness correction map generating unit 104 generates the brightness correction map based on the rotation unevenness correction map and the calculated target brightness unevenness map. The gradation correction map generating unit 102 generates the gradation correction map based on the brightness correction map and the user-measured gamma characteristic, and writes and stores the gradation correction map in the gradation correction map storage unit 110.

The display control unit 107 corrects the gradation of the image signal input from the image input unit 106, based on the gradation correction map stored in the gradation correction map storage unit 110, and displays the image on the display unit 108.

As a result, the display apparatus 1*b* according to the third exemplary embodiment need not perform correction for unevenness correction with respect to a change of the rotation angle of the display unit 108 of the display apparatus 1*b* at the first time point of shipping inspection in the factory, nor for unevenness correction with respect to a change of the rotation angle of the display unit 108 of the display apparatus 1*b* after factory shipment by the user. That is to say, according to the present exemplary embodiment, when the display unit 108 of the display apparatus 1*b* is rotated by a predetermined angle, display unevenness of the image signal due to the rotation of the display unit 108 is corrected according to the gradation correction map. Therefore time-consuming individual unevenness adjustment is performed only in the representative screen direction as in the conventional method. The optical measuring instrument dedicated for measurement of the display screen and the darkroom in which the display apparatus is arranged at the time of measurement, which have been conventionally required at the time of correcting the display unevenness, need not be prepared. Therefore, optical survey items of the display apparatus 1*b* can be the same as those of the conventional apparatus. The production cost can be reduced by simplifying the production process and the adjustment process of display unevenness in the shipping inspection in the factory, being the first time point, and display unevenness of the entire screen 108A of the display unit 108 can be easily corrected in the general user environment at the second time point subsequent to the first time point.

Moreover, in the display apparatus 1*b* according to the third exemplary embodiment, the gradation correction map generating unit 102 can easily generate the gradation correction map based on the brightness correction map and the user-measured gamma characteristic measured after factory shipment, and can record the gradation correction map to the gradation correction map storage unit 110.

Furthermore the display control unit 107 corrects the gradation of the image signal input from the image input unit 106, based on the gradation correction map stored in the gradation correction map storage unit 110, and displays the image on the display unit 108.

As a result, the display apparatus 1*b* according to the third exemplary embodiment can easily correct display unevenness of the entire screen 108A of the display unit 108 by correcting the gradation based on the user-measured gamma characteristic at the specific position in the screen 108A of the display unit 108.

Moreover, the gradation correction basic map storage unit 109*d* stores the gradation correction basic map for each of R, G, and B, and the gradation correction map generating device 10 generates the gradation correction map with respect to the gradation correction basic map for each of R, G, and B.

Accordingly, the display apparatus 1*b* according to the third exemplary embodiment can realize display performance that reproduces a uniform color without display unevenness on the entire screen 108A of the display unit 108.

Fourth Exemplary Embodiment

In a fourth exemplary embodiment, the rotation unevenness map need not be stored in a rotation unevenness map storage unit 109*b* corresponding to each rotation angle (0°, 90°, 180°, and 270°) of a display unit 108. That is to say, as described above, there are only minute changes in rotation unevenness, as there is not much difference between the liquid crystal panels. Therefore, a configuration of storing one type of the rotation unevenness map suffices, even if an aspect ratio of a display screen 108A of the display unit 108 is different. A rotation unevenness correction map generating unit 101 fits the rotation unevenness map so as to correspond to the aspect ratio corresponding to the rotation angle, and reflects the fitted rotation unevenness map so as to correspond to respective positions of the display unit 108 in the brightness unevenness map after fitting.

Here in the case where the rotation unevenness map stored in the rotation unevenness map storage unit 109*b* corresponds to the horizontal installation, when the display unit 108 is rotated by 90°, a horizontal direction of the rotation unevenness map is decreased and a vertical direction thereof is extended so that the aspect ratio becomes the ratio at the time of vertical installation. On the other hand, in the case where the rotation unevenness map stored in the rotation unevenness map storage unit 109*b* corresponds to the vertical installation, when the display unit 108 is rotated by 90°, the horizontal direction of the rotation unevenness map is extended and the vertical direction thereof is decreased so that the aspect ratio becomes the ratio at the time of horizontal installation.

Moreover, after having fitted the rotation unevenness map so as to correspond to the aspect ratio, if there is no data of the rotation unevenness map corresponding to the position in the screen 108A of the display unit 108, the rotation unevenness correction map generating unit 101 reflects data obtained by interpolating the data of the rotation unevenness map, by linear interpolation or the like with respect to the brightness unevenness map.

That is to say, the rotation unevenness map is provided with respect to any one of rotatable rotation angles of the display unit 108, and the rotation unevenness map is used by fitting the aspect ratio so as to correspond to the display surface of the display unit 108 with respect to other rotation angles.

According to the configuration, because the rotation unevenness map need not be prepared for each rotation angle, a display apparatus according to the fourth exemplary embodiment can decrease the storage capacity of the rotation unevenness map storage unit 109*b*, and the cost of the display apparatus can be further reduced as compared with the second exemplary embodiment and the third exemplary embodiment.

Moreover, because the rotation unevenness map need not be prepared for each rotation angle, the time and labor for generating the rotation unevenness map can be saved to reduce the development cost, thereby enabling to reduce the cost of the display apparatus.

Fifth Exemplary Embodiment

In a fifth exemplary embodiment, the rotation unevenness map need not be stored in a rotation unevenness map storage unit 109*b* corresponding to each rotation angle (0°, 90°, 180°, and 270°) of a display unit 108. That is to say, as described above, there are only minute changes in rotation unevenness, as there is not much difference between the liquid crystal panels. Therefore, a configuration in which the rotation unevenness map is not prepared for each rotation angle may be also used.

For example, by inverting the vertical direction to the horizontal direction of the rotation unevenness map corresponding to a rotation angle of 90°, the rotation unevenness map may be used as the rotation unevenness map corresponding to the rotation angle of) −90° (270°).

Moreover, by inverting the vertical direction to the horizontal direction of the rotation unevenness map corresponding to a rotation angle of 0°, the rotation unevenness map may be used as the rotation unevenness map corresponding to the rotation angle of 180°.

That is to say, by rotating the rotation unevenness map, a rotation unevenness map having a different rotation angle can also be calculated.

That is to say, the configuration is such that the rotation unevenness map is provided to any one of rotationally symmetric groups of the rotatable rotation angle of the display unit 108, and with respect to other rotation angles, the display unit 108 is rotated so as to have the same aspect ratio and used.

According to the configuration, because the rotation unevenness map need not be prepared for each rotation angle, the display apparatus according to the fifth exemplary embodiment can decrease the storage capacity of the rotation unevenness map storage unit 109*b*, and the cost of the display apparatus can be further reduced as compared with the second exemplary embodiment and the third exemplary embodiment.

Moreover, because the rotation unevenness map need not be prepared for each rotation angle, the time and labor for generating the rotation unevenness map can be saved to reduce the development cost, thereby enabling to reduce the cost of the display apparatus.

Sixth Exemplary Embodiment

In the second to fifth exemplary embodiments, the rotation unevenness map has been obtained as a design value according to a temperature distribution change determined by the casing structure. However, an unevenness characteristic difference may be calculated by actual measurements in a reference state and at a predetermined rotation angle (90°, 180°, 270°, or the like), to generate the rotation unevenness map.

That is to say, the rotation unevenness map is created by actual measurements at the time of inspection of the display characteristic of the display unit 108 of the display apparatus 1*b*.

According to the sixth exemplary embodiment, display unevenness in a rotated state of a rotation unevenness map generated from actual measurement values can be also corrected highly accurately based on an individual difference of each liquid crystal panel.

A program for realizing respective functions of respective display apparatus 1, 1*a*, and 1*b* of the exemplary embodiment of the present invention shown in FIGS. 1, 2, and 9 may be recorded in a computer readable recording medium, and the program recorded in the recording medium may be read and executed by a computer system, thereby performing control of a suppression process of display unevenness. The "computer system" referred to herein includes hardware such as an OS and a peripheral device.

Moreover, the "computer system" includes a WWW system including a website providing environment (or a display environment). The "computer readable recording medium" stands for portable media such as a flexible disk, a magneto optic disk, a ROM, and a CD-ROM, or a storage device such as a hard disk incorporated in the computer system. Furthermore, the "computer readable recording medium" includes a medium that holds a program for a certain period of time such as a volatile memory (RAM) in the computer system, which becomes a server or a client when the program is transmitted via a network such as the Internet or a communication line such as a telephone line.

Moreover, the above program may be transmitted from a computer system having this program stored in a memory device thereof to another computer system via a transmission medium or by means of transmission waves within the transmission medium. Here, the "transmission medium" that transmits the program refers to a medium having an information transmission function, such as a network including the Internet (communication network) or a communication line including a telephone line (communication wire). Moreover, the above program may realize a part of the functions described above. Furthermore, it may be a so-called difference file (a difference program) that can realize the functions described above, in combination with a program recorded beforehand in the computer system.

What is claimed is:

1. A display apparatus, comprising:

an image input unit that receives an image signal;

a display unit that includes a screen, the display unit being rotatable parallel to the screen;

a gradation correction map generating device that generates a gradation correction map indicating a correspondence relation between a plurality of positions in the screen, and gradation correction values of the image signal at the plurality of positions; and a display control unit that corrects the image signal by using the gradation correction map, wherein the screen displays an image corresponding to the corrected image signal, and wherein the gradation correction map generating device generates the gradation correction map based on a brightness unevenness map, a rotation unevenness map, and a second gamma characteristic, the brightness unevenness map indicating a correspondence relation between the plurality of positions and uncorrected brightness values, the uncorrected brightness values being brightness values at a time of performing no correction when the display unit is installed at a predetermined angle, the rotation unevenness map indicating a correspondence relation between the plurality of positions or other plurality of positions, and differences in brightness values corresponding to a rotation angle of the display unit, the rotation unevenness map further indicating a difference in display unevenness at the plurality of positions, the difference being generated according to the rotation angle of the display unit, the display unevenness being caused by a change of a temperature distribution in the display unit, and the second gamma characteristic indicating a correspondence relation between a brightness value at a specific position in the screen, and a gradation of the image signal.

2. The display apparatus according to claim 1, wherein the uncorrected brightness values include brightness values at a first time point, and wherein the brightness value at the specific position in the screen is a brightness value at a second time point subsequent to the first time point.

3. The display apparatus according to claim 1, wherein the second gamma characteristic indicates the correspondence relation between the brightness value at the specific position in the screen at a second time point subsequent to a first time point, and wherein the gradation correction map generating device includes a brightness unevenness map generating unit that generates the brightness unevenness map based on a gradation correction basic map and a first gamma characteristic, the gradation correction basic map indicating a correspondence relation between the plurality of positions, and gradation correction values of the image signal at the plurality of positions, and the first gamma characteristic indicating a correspondence relation between a brightness value at the specific position or near the specific position on the screen at the first time point, and a gradation of the image signal.

4. The display apparatus according to claim 3, further comprising:

a gradation correction basic map storage unit that stores the gradation correction basic map.

5. The display apparatus according to claim 1, further comprising:

a brightness unevenness map storage unit that stores the brightness unevenness map.

6. The display apparatus according to claim 1, wherein the gradation correction map generating device includes:

a rotation unevenness correction map generating unit that multiplies the rotation unevenness map by the brightness unevenness map to generate a rotation unevenness correction map.

7. The display apparatus according to claim 6, wherein, when there is no data on the rotation unevenness map corresponding to the position in the screen of the display unit, the rotation unevenness correction map generating unit reflects data in which the rotation unevenness map is interpolated by a linear interpolation, with respect to the brightness unevenness map.

8. The display apparatus according to claim 6, wherein the gradation correction map generating device further includes:

a gradation correction map generating unit that generates the gradation correction map based on the rotation unevenness correction map, generated by the rotation unevenness correction map generating unit, and the second gamma characteristic.

9. A display apparatus, comprising:

an image input unit that receives an image signal;

a display unit that includes a screen, the display unit being rotatable parallel to the screen;

a gradation correction map generating device that generates a gradation correction map indicating a correspondence relation between a plurality of positions in the screen, and gradation correction values of the image signal at the plurality of positions; and a display control unit that corrects the image signal by using the gradation correction map, wherein the screen displays an image corresponding to the corrected image signal, wherein the gradation correction map generating device includes:

a rotation unevenness correction map generating unit that generates a rotation unevenness correction map indicating a correspondence relation between the plurality of positions, and correction values of brightness corresponding to a rotation angle of the display unit;

a brightness correction map generating unit that generates a brightness correction map indicating a correspondence relation between the plurality of positions and brightness correction amounts; and a gradation correction map generating unit that generates the gradation correction map, the rotation unevenness correction map generating unit generates the rotation unevenness correction map based on a brightness unevenness map and a rotation unevenness map, the brightness unevenness map indicating a correspondence relation between the plurality of positions and uncorrected brightness values, the uncorrected brightness values being brightness values at a time of performing no correction when the display unit is installed at a predetermined angle, the rotation unevenness map indicating a correspondence relation between the plurality of positions or other plurality of positions, and differences in brightness values corresponding to the rotation angle of the display unit, the rotation unevenness map further indicating a difference in display unevenness at the plurality of positions, the difference being generated according to the rotation angle of the display unit the display unevenness being caused by a change of temperature distribution in the display unit, wherein the brightness correction map generating unit generates the brightness correction map based on the rotation unevenness correction map, and a specified unevenness level value, and wherein the gradation correction map generating unit generates the gradation correction map based on the brightness correction map and a second gamma characteristic, the second gamma characteristic indicating a correspondence relation between a brightness value at a specific position in the screen, and a gradation of the image signal.

10. The display apparatus according to claim 9, wherein the uncorrected brightness values include brightness values at a first time point, and wherein the brightness value at the specific position in the screen includes a brightness value at a second time point subsequent to the first time point.

11. The display apparatus according to claim 9, wherein the brightness correction amounts include a difference or a ratio between the uncorrected brightness values, and target brightness values at the plurality of positions.

12. The display apparatus according to claim 9, wherein the rotation unevenness correction map generating unit multiplies the rotation unevenness map by the brightness unevenness map to generate the rotation unevenness correction map.

13. The display apparatus according to claim 9, wherein, when there is no data on the rotation unevenness map corresponding to the position in the screen of the display unit, the rotation unevenness correction map generating unit reflects data in which the rotation unevenness map is interpolated by a linear interpolation, with respect to the brightness unevenness map.

14. The display apparatus according to claim 9, wherein the gradation correction map generating unit generates the gradation correction map based on the rotation unevenness correction map, generated by the rotation unevenness correction map generating unit, and the second gamma characteristic.

15. A gradation correction map generating device, comprising:

a gradation correction map generating unit that generates a gradation correction map based on a brightness unevenness map, a rotation unevenness map, and a second gamma characteristic, the brightness unevenness map indicating a correspondence relation between a plurality of positions in a screen of a display unit, and uncorrected brightness values, the uncorrected brightness values being brightness values at a time of performing no correction when the display unit is installed at a predetermined angle, the rotation unevenness map indicating a correspondence relation between the plurality of positions or other plurality of positions, and differences in brightness values corresponding to a rotation angle of the display unit, the rotation unevenness map further indicating a difference in display unevenness at the plurality of positions, the difference being generated according to the rotation angle of the display unit, the display unevenness being caused by a change of temperature distribution in the display unit, the second gamma characteristic indicating a correspondence relation between a brightness value at a specific position in the screen, and a gradation of an image signal.

16. The gradation correction map generating device according to claim 15, wherein the gradation correction map generating device further includes:

a rotation unevenness correction map generating unit that multiplies the rotation unevenness map by the brightness unevenness map to generate a rotation unevenness correction map.

17. The gradation correction map generating device according to claim 16, wherein, when there is no data on the rotation unevenness map corresponding to the position in the screen of the display unit, the rotation unevenness correction map generating unit reflects data in which the rotation unevenness map is interpolated by a linear interpolation, with respect to the brightness unevenness map.

18. The gradation correction map generating device according to claim 15, wherein the gradation correction map generating unit generates the gradation correction map based on the rotation unevenness correction map, generated by the rotation unevenness correction map generating unit, and the second gamma characteristic.

* * * * *